US006607392B2

(12) United States Patent
Kondoh

(10) Patent No.: US 6,607,392 B2
(45) Date of Patent: Aug. 19, 2003

(54) GROUND JOINT CONNECTOR

(75) Inventor: Tatsuya Kondoh, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 55 days.

(21) Appl. No.: 09/902,658

(22) Filed: Jul. 12, 2001

(65) Prior Publication Data

US 2002/0009909 A1 Jan. 24, 2002

(30) Foreign Application Priority Data

Jul. 13, 2000 (JP) ..... 2000-213282

(51) Int. Cl.[7] ..... H01R 13/648
(52) U.S. Cl. ..... 439/92; 439/790
(58) Field of Search ..... 439/86, 88, 92, 439/97, 607, 790, 931, 939

(56) References Cited

U.S. PATENT DOCUMENTS 4,146,291 A * 3/1979 Goff et al.
5,647,765 A * 7/1997 Haaz et al. ..... 439/609
6,206,728 B1 * 3/2001 Krehbiel et al. ..... 439/607

FOREIGN PATENT DOCUMENTS

JP 10237331 9/1998
JP 11-34252 2/1999

OTHER PUBLICATIONS

English Language Abstract of JP 10–237331.
English Language Abstract of JP 11–34252.

* cited by examiner

*Primary Examiner*—Khiem Nguyen
(74) *Attorney, Agent, or Firm*—Greenblum & Bernstein, P.L.C.

(57) ABSTRACT

A ground joint connector is provided including at least one connector housing configured to receive and hold at least one terminal of at least one electric wire, and a holder formed from a high-conductivity resin. The holder has a plurality of connector holding portions, each configured to receive and hold the at least one connector housing. The ground joint connector further includes a ground terminal provided on an outer surface of the holder. Each terminal of each electric wire received and held by each connector housing contacts the holder so as to be grounded via the holder and the ground terminal.

9 Claims, 6 Drawing Sheets

PRIOR ART

PRIOR ART

GROUND JOINT CONNECTOR

BACKGROUND OF THE INVENTION

1. Field of the Invention

The present invention relates to a ground joint connector, and in particular, relates to reduction of the number of components regarding the ground joint connector, and reduction of the number of ground holes provided in an automobile body, so as to make assembly and mounting of ground portions of a wire harness simpler and easier.

2. Description of Related Art

To establish a ground connection of electric wires forming wire harnesses mounted on an automobile, an end of each electric wire is connected to a terminal, and the terminal engages with a joint connector. Thus, the wire harness is grounded to an automobile body, and so on, via the joint connector.

As shown in FIG. 4(A), in a conventional ground joint connector, male tab portions 7*a* formed at the end of a joint bus bar 7*a* are respectively inserted into and engage with terminal holding portion 8*b* in a housing 8*a* of a female connector 8. As shown in FIG. 4(B), a terminal 6 connected to an end of an electric wire w is inserted into and engages with a connector housing 5*a* of a male connector 5. Then, the male connector 5 engages with the female connector 8, in order to connect each terminal 6 to the joint bus bar 7. The joint bus bar 7 is provided with a ground terminal 7*b*.

FIG. 5 illustrates a wire harness w that is grounded to an automobile body using the joint connector. The joint connector, which includes the male and female connectors 5 and 8 to engage with one another, is mounted on an automobile body panel P. A ground terminal 7*b* projecting from the joint bus bar 7 is aligned with a ground hole Pa provided in the automobile body panel P. Then, a bolt B is inserted into the aligned ground terminal 7*b* and the ground hole Pa, and is threaded into a nut N fixed on a rear surface of the automobile panel P. Thus, a ground connection to an automobile body can be provided.

According to the conventional ground joint connector described above, the female connector 8, as shown in FIG. 4(A), is formed by inserting each male tab portion 7*a* of the joint bus bar 7 into each terminal holding portion 8*b* of the housing 8*a*, so as to engage with one another. On the other hand, at the wire harness W/H side, as shown in FIG. 4(B), a (female) terminal 6 press-fit to an end of each electric wire d forming the wire harness W/H, is inserted into each terminal holding portion 5*b* of the housing 5*a* of the male connector 5, so as to engage with one another.

Since the ground connection of the wire harness W/H is provided as described above, many components, such as the housing 5*a* of the male connector 5, the female terminals 6, the housing 8*a* of the female connector 8, and the joint bus bar 7, are required. Thus, the requirement of many components results in a high cost. Further, since many components are required, assembly of each component and assembly (connection) among the components require more load and time. Thus, the assembly of the wire harness is prevented from being efficient.

Further, since, in the ground joint connector described above, the ground terminal side connector (female connector 8) and the wire harness side connector (male connector 5) are connected one-to-one, when many wire harness side connectors are required to ground wire harnesses, ground terminal side connectors respectively corresponding to the wire harness side connectors are also required. In addition, since ground terminals for the respective joint connectors should be connected to the automobile body panel, the number of ground holes provided in the automobile body panel also increases.

Accordingly, the present invention is provided in view of the above-described problems, and an objective of the present invention is to reduce the number of components regarding a ground joint connector, to use common components, and to miniaturize the components. At the same time, another objective of the present invention is to reduce the number of ground holes provided in the automobile body, and to make assembly and connection work regarding the ground connection efficient.

SUMMARY OF THE INVENTION

To achieve the above and/or other goals, the present invention provides a ground joint connector including at least one connector housing, each configured to receive and hold at least one terminal of at least one electric wire, and a holder that is formed from a high-conductivity resin and has a plurality of connector holding portions. Each of the plurality of connector holding portions is configured to receive and hold each of the at least one connector housing. The ground joint connector further includes a ground terminal provided on an outer surface of the holder. Each terminal of each electric wire received and held by each connector housing contacts the holder so as to be grounded via the holder and the ground terminal.

Preferably, the at least one connector housing is formed from a high-conductivity resin, and the ground terminal is formed unitarily and in one piece with the holder.

According to the ground joint connector of the present invention, the holder, configured as a female connector, and the connector housing, configured as a male connector, both of which directly hold strands (conductor) of each electric wire forming a wire harness, are made from a high-conductivity resin. The high-conductivity resin is a high conductivity electrical conductor, and according to the construction in which the electric wire is directly held between the high electric conductors, a conventional terminal, which is connected to an end of an electric wire, and a bus bar are not necessary. Therefore, the ground connection can be provided without these conventional components, and thus, the number of components can be reduced.

According to another aspect of the present invention, a ground joint connector is provided including a plurality of connector housings, each configured to receive and hold at least one terminal of at least one electric wire, a primary holder formed from a high-conductivity resin, and at least one subordinate holder formed from a high-conductivity resin. The primary holder includes a connector holding portion configured to receive and hold one of the plurality of connector housings, a ground terminal provided on an outer surface of the primary holder, and a first engaging portion provided on an outer surface of the primary holder. Each of the at least one subordinate holder includes a connector holding portion configured to receive and hold another of the plurality of connector housings, a second engaging portion having a shape substantially the same as that of the first engaging portion, and a third engaging portion configured to engage with one of the first engaging portion of the primary holder and the second engaging portion provided on an adjacent subordinate holder. The primary holder and at least one subordinate holder are electrically connected to one another by engagement of the first, second and third engaging portions. Each terminal of each electric wire received and held by each connector housing contacts one of the primary holder or the at least one subordinate holder so as to be grounded via the connector holding portion of the primary holder and the ground terminal.

Preferably, the plurality of connector housings is formed from a high-conductivity resin, and the ground terminal is formed unitarily and in one piece with the primary holder.

According to the construction described above, since plural high-conductivity resin connector housings, each of which receives and holds at least one terminal of at least one electric wire, are inserted into and engage with high-conductivity resin holders arranged in parallel, and each of which having a connector holding portion, the ground terminal can be shared because of the function of the high-conductivity resin. Thus, a single ground terminal is necessary only on a single holder. Accordingly, the holder that does not have the ground terminal can be miniaturized, and only a single ground hole is sufficient to be provided in the automobile body panel. The use of a common ground terminal and the miniaturization of the holder results in a reduction of cost of the components, and the reduction in the number of ground holes reduces time and cost, and thus improves work efficiency.

It is preferable that the holder is a female connector and the connector housing is a male connector. Further, a plurality of electric wire guide grooves are provided on a upper surface of the connector housing, and electric wires are inserted into and engage with the plurality of electric wire guide grooves, respectively. Each electric wire with exposed strands (conductor) at an end is pressed and held between the inner surface of the holder and an end face of the connector housing, when the connector housing engages with and is locked in the holder.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

Hereinafter, embodiments of the present invention are explained with reference to drawings.

Figure 1:
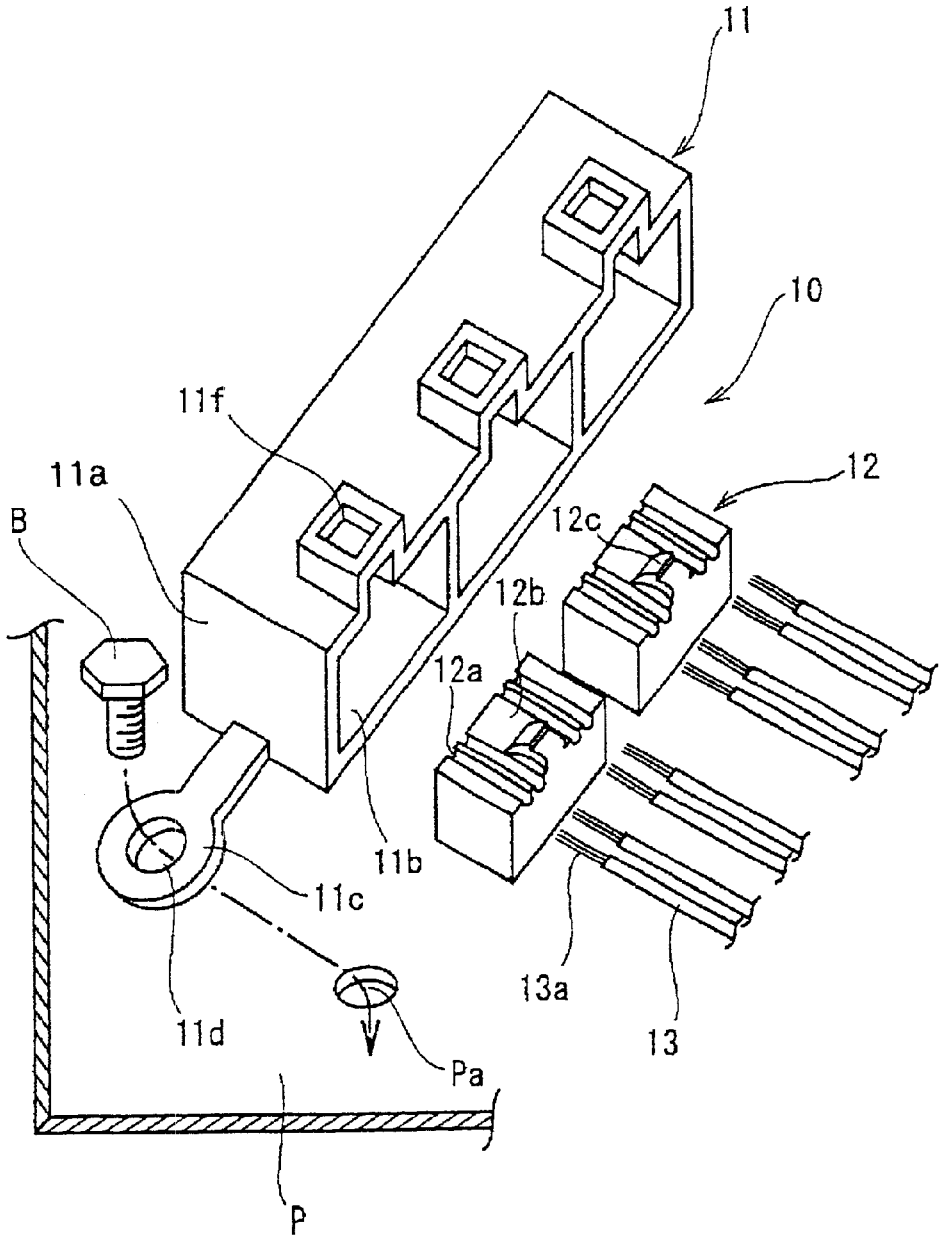
FIG. 1 is a perspective view illustrating a joint connector according to a first embodiment of the present invention.

FIG. 1 illustrates a ground joint connector 10 according to a first embodiment of the present invention. The ground connector 10 is formed by a high-conductivity resin, and includes a holder 11 and a connector housing 12.

The high-conductivity resin can be, as disclosed in Japanese Laid-Open Publication No. 10-237331, or 11-34252, a conductive resin composite obtained by diffusing a thermoplastic resin into which a metal fiber, including a copper, a nickel, an iron, or the like, is added, into a low fusion point alloy, which is composed of, for example, a lead-free solder (low fusion point solder) and a Cu powder, or the like.

As the thermoplastic resin, into which the conductive metal fiber is compounded, one of or a blend of the following resins can be used: a propylene, a polyethylene, a polystyrene, an acrylonitrile, a butadiene, a styrene resin, a metamorphic polyphenylene oxide resin, a polybutylene terephthalate resin, a polyamide resin, an aromatic polyamide resin, a polyphenylene sulfide resin, a liquid crystal polymer, a polyether imide, a polybenzimidazole, a polyether etherketone, a polyether sulfone. Preferably, the thermoplastic resin is one of acrylonitrile, butadiene, styrene resin, and polybutylene terephthalate resin.

The low fusion point alloy, which is added and diffused into the thermoplastic resin, and connected (joined) with the thermoplastic resin to form a network structure, has a fusion point higher than 100° C., preferably, higher than 200° C., and is an alloy that melts at the time of injection molding. The following low fusion point alloys can be used: Sn—Pb system, Sn—Ag—Pb system, Sn—Bi system, Sn—Bi—In system, Bi—Pb system, Bi—Sn system, Sn—Cu system, Sn—Cu—Ni—P system, Sn—Ag system, Sn—Bi—Pb system and Sn—In system.

The holder 11 includes a box-shaped housing 11*a*, and a plurality of connector holding portions 11*b* arranged in parallel. The connector holding portions 11*b* have an opening and respectively receive and engage with the connector housings 12. A flat-type ground terminal 11*c* extends outwardly from a closed surface of the holder 11. A ground bolt mounting hole 11*d* is provided at an end of the ground terminal 11*c*. The ground terminal 11*c* is formed unitarily and in one piece with the housing 11*a*. Alternatively, the ground terminal 11*c* may be formed separately from the housing 11*a* and fixedly attached thereto.

The housing 11*a* of the holder 11 further includes plural receiving portions 11*f* to engage with portions of the connector housings 12. The receiving portions 11*f* are provided respectively corresponding to the connector holding portions 11*b*.

The connector housings 12 have a generally block-shape. Plural (four, in the present embodiment) electric wire guide grooves 12*a*, each of which is formed to fit to the shape of an electric wire 13, are arranged in parallel on the upper surface 12*b* of the connector housing 12. Further, an engaging portion 12*c*, which engages with and is locked in the receiving portion 11*f* at the time of engagement with the holder 11, is provided on the upper surface 12*b*.

Figure 2:
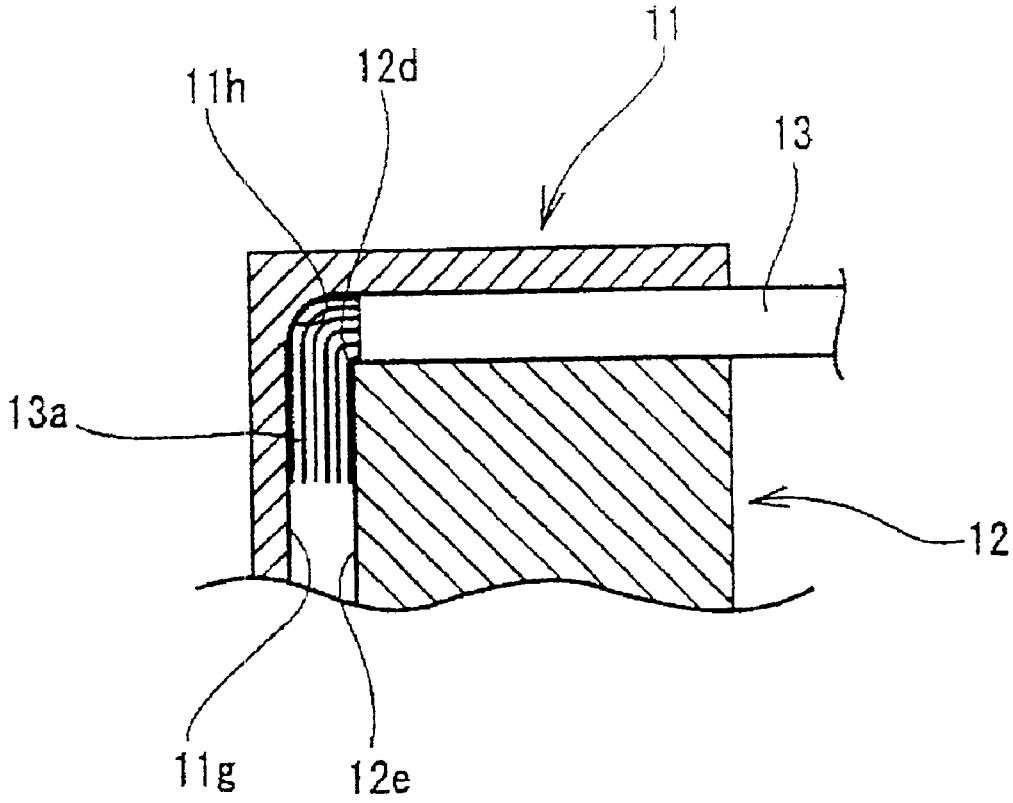
FIG. 2 is a cross-sectional view illustrating a portion of a ground connection of the joint connector according to the first embodiment and a second embodiment of the present invention.

FIGS. 1 and 2 show a ground connection using the ground joint connector 10 according to the present invention.

First, a covering resin (insulator) that covers an end of an electric wire 13 used for ground connection is stripped off so that strands (conductors) 13*a* are exposed. The electric wire 13 with the exposed strands 13*a* is inserted into the electric wire guide groove 12*a* provided on the connector housing 12. At this time, each electric wire is located so that the strands 13*a* extend past the end 12*d* of the guide groove 12*a* in the insertion direction of the electric wire 13. While the above-described placement of the electric wire is maintained, the connector housing 12 is inserted into and engages with the connector holding portion 11*b* of the holder 11. Then, the engaging portion 12*c* engages with the receiving portion 11*f* so that the holder 11 and the connector housing 12 are engaged and locked. The corner 11*h* of the inner wall surface 11*g* is curved, so that the strands 13 a can be easily bent at the time of engagement.

When the connector housing 12 engages with and is locked in the holder 11, the end portion of the strands 13 a is inserted along the curved corner 11*h* of the holder 11, and is bent at the end 12*d* of the electric wire guide groove 12*d*. Thus, the strands 13*a* are pressed and held between the inner wall surface 11*g* of the holder 11 and the end face 12*e* of the connector housing 12. Accordingly, the strands 13*a* and the inner wall surface of the holder 11 have broad-contact with one another and are electrically connected with each other. Thus, the strands 13*a* establish conductivity with the ground terminal 11*c* through the housing 11*a*. Finally, the ground terminal is fixed to an automobile body panel P by inserting the bolt B into the ground bolt mounting hole 11*d* and the ground hole in the automobile body panel P and by threading the bolt B in a nut (not shown).

Figure 3:
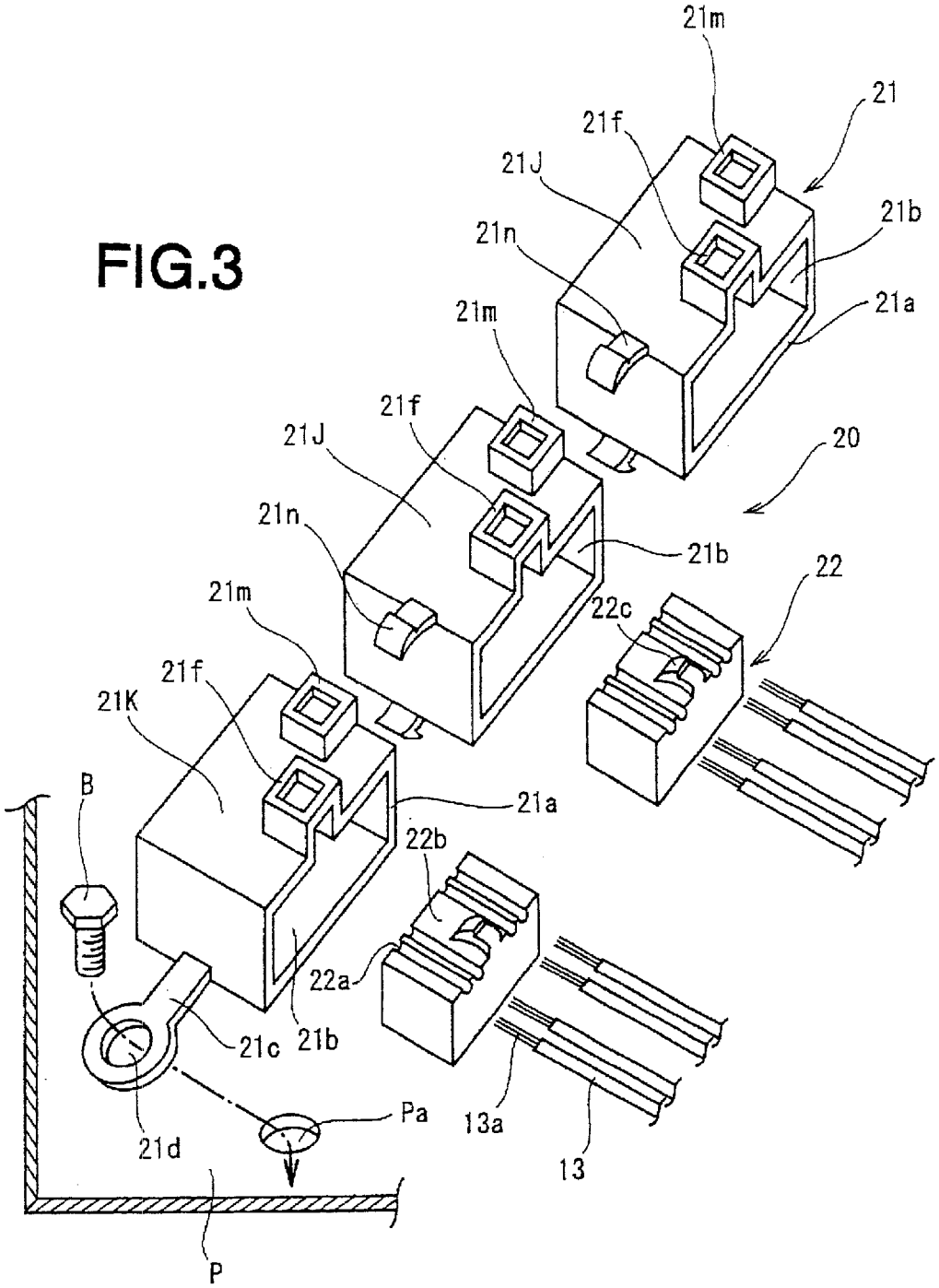
FIG. 3 a perspective view illustrating a joint connector according to the second embodiment of the present invention.
Figure 4A:
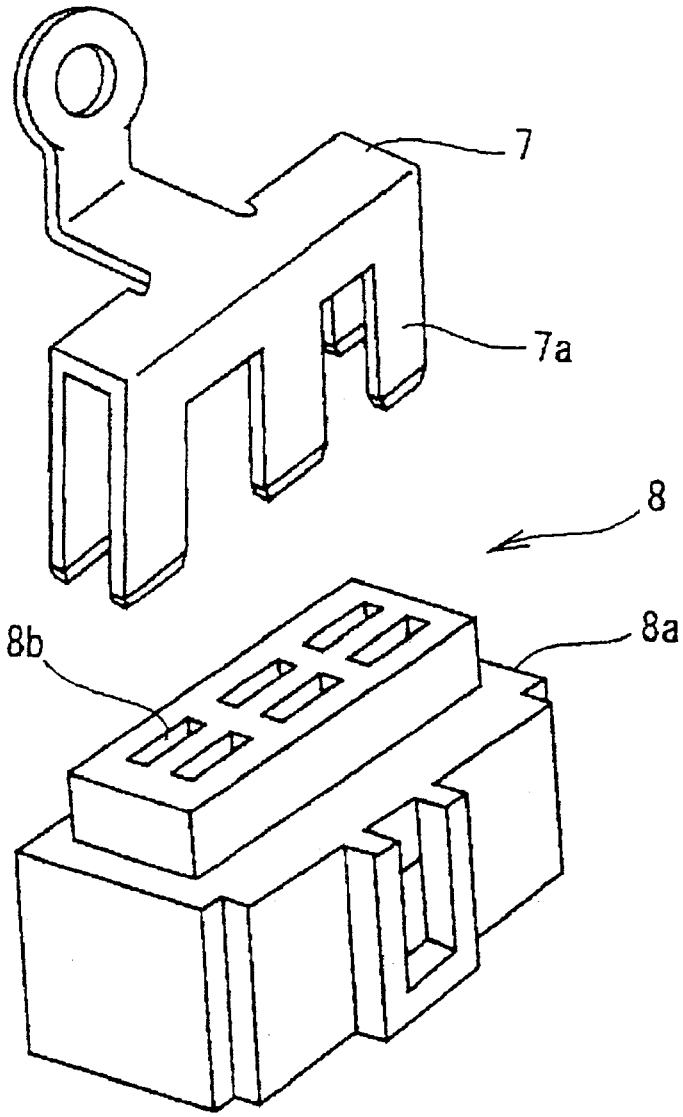
FIG. 4(A) is an exploded perspective view of a conventional joint connector.
Figure 4B:
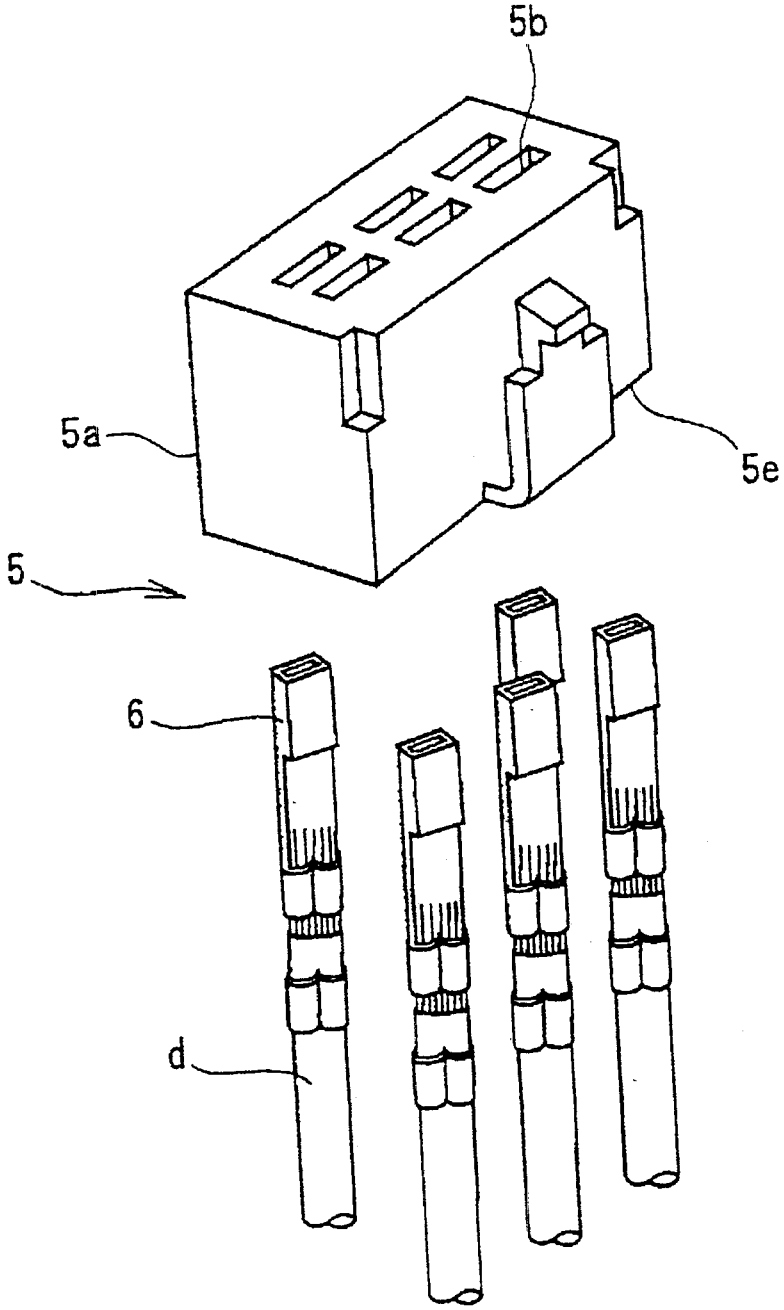
FIG. 4(B) is a schematic view of a conventional connection between a wire harness side connector and terminals of wire harnesses.
Figure 5:
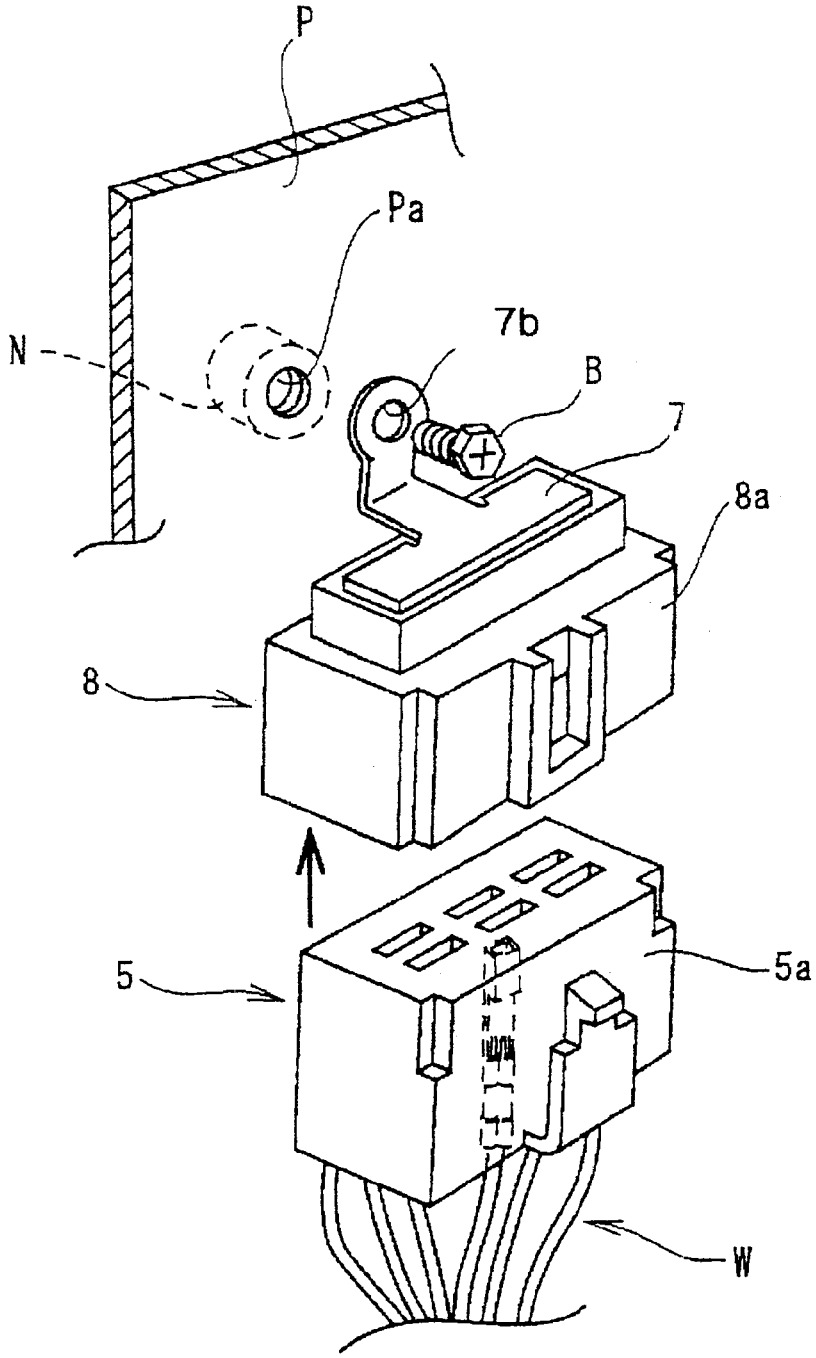
FIG.5 PRIOR ART
FIG. 5 is a perspective view illustrating ground connection according to a conventional joint connector.

FIG. 3 illustrates a ground joint connector 20 according to the second embodiment of the present invention. This ground joint connector 20 of the second embodiment includes, like the ground joint connector 10 of the first embodiment, a holder 21 and a connector housing 22, both made from a high-conductivity resin. However, it is different from the first embodiment that the holder 21 includes plural holder components 21K, 21J.

The holder 21 of the second embodiment includes a single primary holder 21K and at least one subordinate holder 21J, and in the embodiment depicted in FIG. 3, includes, two subordinate holders 21J. The desired number of the subordinate holders 21J is detachably connected to the primary holder 21K in the manner described below.

The primary holder 21K includes a box-shaped housing 21*a*, a single connector holding portion 21*b* that receives and engages with the connector housing 22, a ground terminal 21*c* having a ground bolt attachment hole 21*d*, a receiving portion 21*f* to engage with the connector housing 22, and a receiving portion 21*m* to engage with the subordinate holder 21J. A feature of the primary holder 21K (i.e. the differences from the subordinate holder 21J) is that the primary holder 21K has the ground terminal 21*c*, and does not include engaging portion 21*n*, as described below.

The subordinate holder 21J includes, similar to the primary holder 21K, a box-shaped housing 21*a*, a single connector holding portion 21*b* that receives and engages with the connector housing 22, a receiving portion 21*f* to engage with the connector housing 22 and a receiving portion 21*m* to connect to a succeeding subordinate holder 21J. The subordinate holder 21J further includes an engaging portion 21*n* to connect to the primary holder 21K or to a preceding subordinate holder 21J. Thus, the subordinate holder 21J does not have the ground terminal; instead, the subordinate holder 21J has the engaging portion 21*n*.

The primary holder 21K and the subordinate holder 21J engage with and are locked to one another by inserting the engaging portion 21*n* of the subordinate holder 21J into the receiving portion 21*m* of the primary holder 21K to engage with one another. Further, when two subordinate holders 21J are intended to be connected, the engaging portion 21*n* of a succeeding subordinate holder 21J is inserted into the receiving portion 21*m* of a preceding subordinate holder 21J to engage with and locked in one another. Thus, the required number of subordinate holders are connected in this manner.

The construction of the connector housing 22 is generally the same as that of the connector housing 12 of the first embodiment. Accordingly, only a simple explanation is given here. Electric wire guide grooves 22*a* are arranged on an upper surface 22*b* of the connector housing 22. An electric wire with exposed strands (conductor) is inserted into each electric wire guide groove 22*a*. In this condition, the connector housing 22 is inserted into and engages with the connector holding portion 21*b* of either of the primary holder 21K or the subordinate holder 21J. By the engaging portion 22*c* and the receiving portion 21*f*, the holder 21 (21K, 21J) and the connector housing 22 engage with and are locked to one another.

The construction of the engagement (lock) between the holder and the connector housing is not limited to the construction using the receiving portion 21*f* and the engaging portion 22*c*, as shown in the figures. Rather, any suitable construction that connects a variety of holders with a variety of connector housings to be locked or engage with one another can be used.

Further, in each of the above-described embodiments, the electric guide groove is provided on the connector housings 12, 22. However, the electric wire guide groove can be provided on the holder 11, 21, instead. Further, the electric wire guide groove can be provided on both of the holder 11, 21 and the connector housing 12, 22.

Additionally, the connector housing 11, 21 can be formed by a normal resin, instead of the high-conductivity resin, if at least the holders 11, 21 are made from the high-conductivity resin.

Alternatively, the holder can be a box-shape having an open upper surface, and can have an electric wire guide groove on an inner surface of a side wall. In this case, a connector housing having a projecting strip or a projection can be inserted into and engage with the holder from the upper side. In this case, the holder can have a hole fitting with the projecting strip or the projection. Thus, the connecting construction of the electric wires is not limited to the above-described methods. Rather, any construction in which the strands are pressed and held between the holder and the connector housing, and the strands have broad-contact with the holder to establish electric connection.

As clearly described above, by using the joint connector according to the present invention, when compared with the conventional method, since the press-fit terminals provided on an end of each electric wire forming a wire harness W/H, and a bus bar are not required. Thus, the number of components required for the ground connection is reduced. Further, the time required for the assembly can be reduced, and thus, the cost can also be reduced. Further, by using the high-conductivity resin, since no metal member is used, the weight can be reduced. Further, according to the reduction of the number of components, the workload required for management of manufacturing and storing of the components can be reduced. Thus, the managing work can also become more efficient.

Further, when the high-conductivity resin connector housing and a high-conductivity resin holder according to the present invention are used, because of the high-conductivity function of those components, a ground terminal can be shared with the plural connection housings. Thus, a single ground terminal provided on only a single holder is sufficient. Accordingly, the holder that does not have the ground terminal can be miniaturized, and only a single ground hole is sufficient to be provided in the automobile body panel. The use of a common ground terminal and the miniaturization the holder realize reduction of cost regarding the components, and the reduction of the ground hole reduces time and cost, and thus improve work efficiency.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The present disclosure relates to subject matter contained in priority Japanese Application No. 2000-213282, filed on Jul. 13, 2000, the disclosure of which is herein expressly incorporated by reference in its entirety.

What is claimed is:

1. A ground joint connector comprising:

at least one connector housing configured to receive and hold at least one conductive terminal of at least one electric wire;

a conductive holder formed from a high-conductivity resin, the holder having a plurality of conductive connection holding portions, each of the plurality of connector holding portions being configure to receive and hold each of the at least one connector housing; and a ground terminal provide on an outer surface of the holder, the ground terminal formed from the high-conductivity resin unitarily and in one piece with the conductive holder;

wherein each conductive terminal of each electric wire received and held by each connector housing contacts the conductive holder so as to be ground via the holder and the ground terminal.

2. The ground joint connector according to claim 1, wherein the at least one connector housing is formed from a high-conductivity resin.

3. The ground joint connector according to claim 1, wherein the connector housing has a plurality of wire guide grooves arranged in parallel on a surface, and each electric wire is inserted into and held by a respective one of the plurality of wire guide grooves.

4. A ground joint connector comprising:

at least one connector housing configured to receive and hold at least one terminal of at least one electric wire;

a holder formed from a high-conductivity resin, the holder having a plurality of connector holding portions, each of the plurality of connector holding portions being configured to receive and hold each of the at least one connector housing; and a ground terminal provider on an outer surface of the holder, wherein each terminal of each electric wire received and held by each connector housing contacts the holder so as to be ground via the holder and the ground terminal;

wherein the terminal of each electric wire is provided by stripping off an insulator at an end of the electric wire to expose a conductor, and wherein the exposed conductor is held between an inner surface of the holder and an end face of a respective connector housing.

5. A ground joint connector comprising:

a plurality of connector housings, each configured to receive and hold at least one terminal of at least one electric wire;

a primary holder formed from a high-conductivity resin, the primary holder comprising:

a connector holding portion configured to receive and hold one of the plurality of connector housings:

a ground terminal provided on an outer surface of the primary holder; and a first engaging portion provided on an outer surface of the primary holder; and at least one subordinate holder formed from a high-conductivity resin, the at least one subordinate holder comprising:

a connector holding portion configured to receive and hold another of the plurality of connector housings;

a second engaging portion having a shape substantially the same as that of the first engaging portion; and a third engaging portion configured to engage with one of the first engaging portion of the primary holder and the second engaging portion provided on an adjacent subordinate holder, wherein the primary holder and at least one subordinate holder are electrically connected to one another by engagement of the first, second and third engaging portions, and wherein each terminal of each electric wire received and held by each connector housing contacts one of the primary holder and the at least one subordinate holder so as to be grounded via the connector holding portion of the primary holder and the ground terminal.

6. The ground joint connector according to claim 5, wherein the plurality of connector housings is formed from a high-conductivity resin.

7. The ground joint connector according to claim 5, wherein the ground terminal is formed unitarily and in one piece with the primary holder.

8. The ground joint connector according to claim 5, wherein each connector housing has a plurality of wire guide grooves arranged in parallel on a surface, and each electric wire is inserted into and held by each of the plurality of wire guide grooves.

9. The ground joint connector according to claim 5, wherein each terminal of each electric wire is provided by stripping off an insulator at an end of the electric wire to expose a conductor, and wherein the exposed conductor is held between an end face of each connector housing and an inner surface of one of the primary holder and the at least one subordinate holder.

* * * * *